US005191859A

United States Patent [19]

Fujiwara

[11] Patent Number: 5,191,859

[45] Date of Patent: Mar. 9, 1993

[54] WATER PUMPING APPARATUS FOR AN INTERNAL COMBUSTION ENGINE

[75] Inventor: Hideo Fujiwara, Shizuoka, Japan

[73] Assignee: Suzuki Motor Corporation, Shizuoka, Japan

[21] Appl. No.: 835,183

[22] Filed: Feb. 12, 1992

[30] Foreign Application Priority Data

Feb. 22, 1991 [JP] Japan ..... 3-050761

[51] Int. Cl.[5] ..... F01P 5/10

[52] U.S. Cl. ..... 123/41.44; 123/41.47

[58] Field of Search ..... 123/41.44, 41.47

[56] References Cited

U.S. PATENT DOCUMENTS 4,971,000 11/1990 Shimura et al. ..... 123/41.44

FOREIGN PATENT DOCUMENTS 60-67716 4/1985 Japan .

62-96737 5/1987 Japan .

*Primary Examiner*—Noah P. Kamen

*Attorney, Agent, or Firm*—Flynn, Thiel, Boutell & Tanis

[57] ABSTRACT

In a water pumping apparatus for an internal combustion engine, a water pump sprocket has a timing chain wound thereon so that the water pump may be driven by the timing chain. The water pump is provided at one end face of the cylinder block within a timing chain cover enclosing the timing chain.

2 Claims, 5 Drawing Sheets

WATER PUMPING APPARATUS FOR AN INTERNAL COMBUSTION ENGINE

FIELD OF THE INVENTION

The present invention relates to a water pumping apparatus for an internal combustion engine, particularly wherein a cam shaft is driven by a timing chain.

BACKGROUND OF THE INVENTION

Internal combustion engines for vehicles include those wherein cylinders are disposed in series or in opposed relationship, bank cylinders are arranged in the form of a V, i.e., a V-type internal combustion engine, and so on. The V-type internal combustion engine includes first and second cylinder banks in a V-shaped cylinder block on which first and second cylinder heads are mounted. These cylinder heads are covered with first and second cylinder head covers.

A crank shaft extended lengthwise of the internal combustion engine is arranged rotatably bidirectionally at a generally central portion of the cylinder block mentioned above. The crank shaft drives auxiliary units of a valve system, such as a cam shaft, and a water pump.

The front end of the first cylinder head is protruded more forwardly of the internal combustion engine than the front end face of the second cylinder head relative to the axis of the crank shaft. The cylinder heads are provided with first and second rotatable cam shafts. First and second cam shaft sprockets are provided coextensively with one another at the ends of the first and second cam shafts in the front of the V-type internal combustion engine. A timing chain sprocket is provided at the end of the crank shaft in the front of the V-type internal combustion engine, coextensive with the first and second cam shaft sprockets. A timing chain is wound between the timing chain sprocket and the first and second cam shaft sprockets.

In another type of V-type internal combustion engine a timing belt communicates between cam shaft pulleys provided on the cam shafts and a crank shaft pulley on the crank shaft.

Unexamined patent publication No. 67716 of the year 1985 discloses a cooling system for a V-type internal combustion engine which allows less circulating water flow to a cylinder bank in the front than to another cylinder bank in the rear relative to the straight travel direction of the vehicle.

Another type of V-type internal combustion engine is disclosed in unexamined patent publication No. 96737 of the year 1987. In the engine, the water pump and auxiliary components outside the water pump consisting of driven pulleys are accommodated in a V-valley in the upper center of a cylinder block containing two cylinder rows defined by cylinders arranged in series. A timing belt transmission system connecting between the water pump and the crank shaft and a belt transmission system connecting between the auxiliary components and the crank shaft are in as such order successively aligned with a wall opposite to the timing belt in the cylinder block.

In some water pumping apparatuses of conventional internal combustion engines, a water pump is installed directly on the end face of the cylinder block, i.e., the outer side face thereof. Alternatively, it is fitted on a timing chain cover provided with the cylinder block.

The former described above includes those apparatuses in which a water pump pulley is driven by a timing belt, or alternatively, by a V-belt or a V-ribbed belt with the timing belt or a timing chain disposed to avoid a space of installing the water pump.

In the latter described above, the water pump pulley was driven by the V-belt or the V-ribbed belt.

Concomitantly, the internal combustion engine wherein the cam shaft is driven by the timing chain requires driving the water pump pulley using the V-belt or the V-ribbed belt disposed on the outer side of the timing chain. Specifically, the water pump pulley is extended to be driven by the V-belt or the V-ribbed belt independently of a location at which the water pump is disposed. This disadvantageously enlarges the overall length and width of the internal combustion engine, which becomes large in size.

In an attempt to eliminate the problem just mentioned, the present invention is provided for an internal combustion engine wherein a cam shaft is driven by a timing chain. The invention is characterized by: a water pump sprocket disposed coextensively with the timing chain to allow the timing chain to drive the water pump; and the water pump is provided at the end face of the cylinder block within a timing chain cover enclosing the timing chain.

In accordance with the invention as stated above, the water pump is installed at the end face of the cylinder block; the timing chain is wound on the water pump sprocket of the water pump; the water pump and the timing chain are enclosed by a timing chain cover; and the water pump is driven by the timing chain. This reduces the overall length and width of the internal combustion engine.

BRIEF DESCRIPTION OF THE DRAWINGS

Embodiments of the invention will now be described with reference to the drawings, in which.

DETAILED DESCRIPTION

Figure 1:
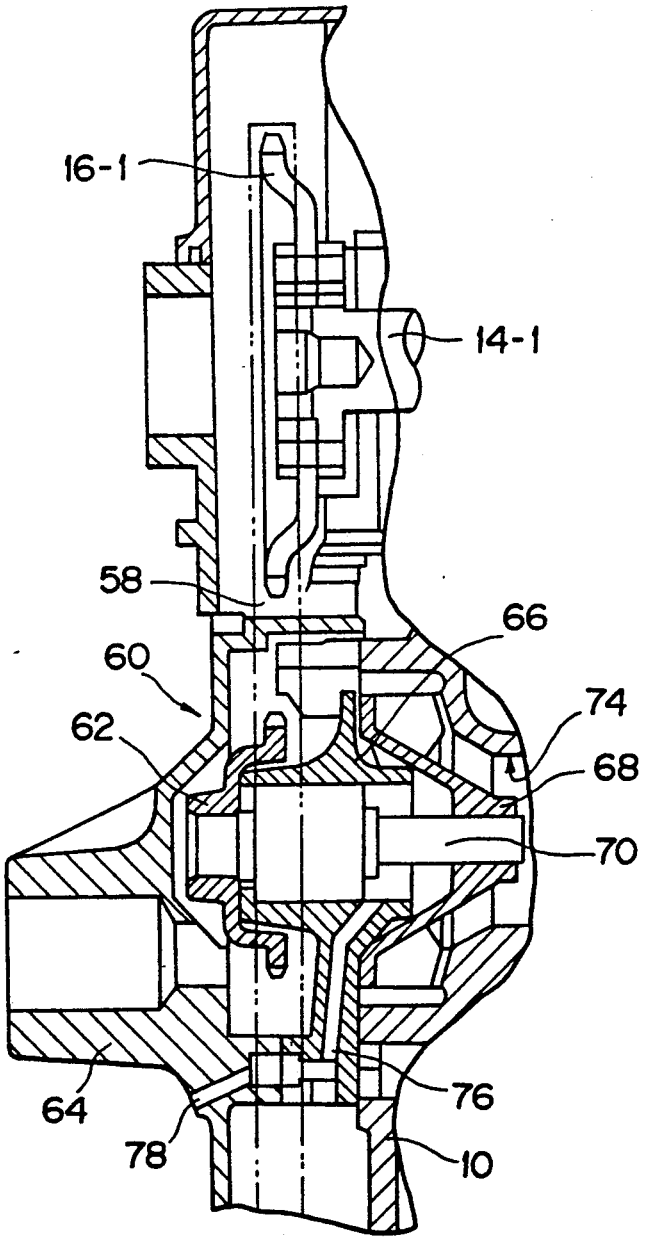
FIG. 1 is a fragmentary sectional view showing a water pump in an internal combustion engine according to an embodiment of the present invention.
Figure 2:
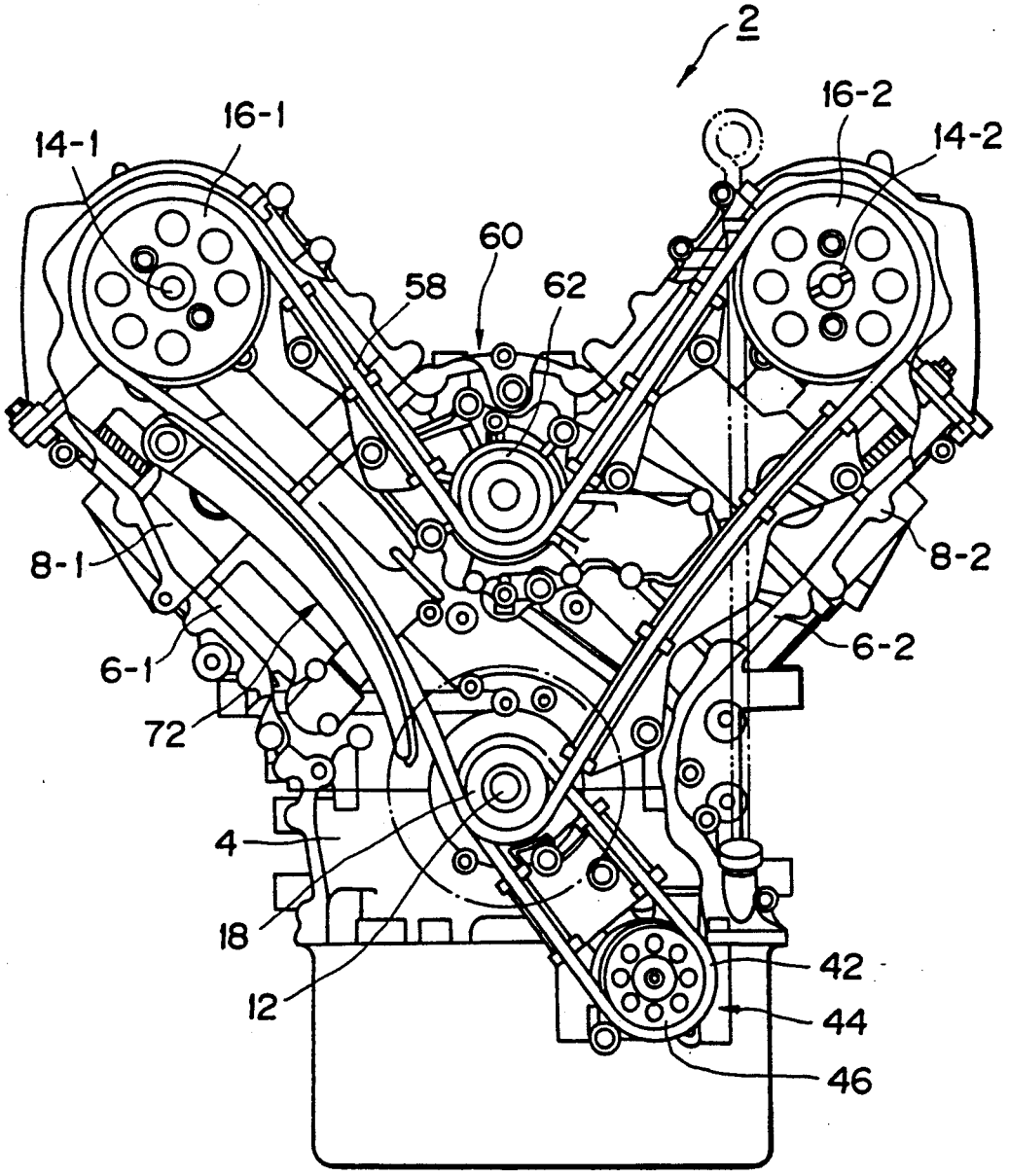
FIG. 2 is a schematic front view showing an internal combustion engine which embodies the invention.
Figure 3:
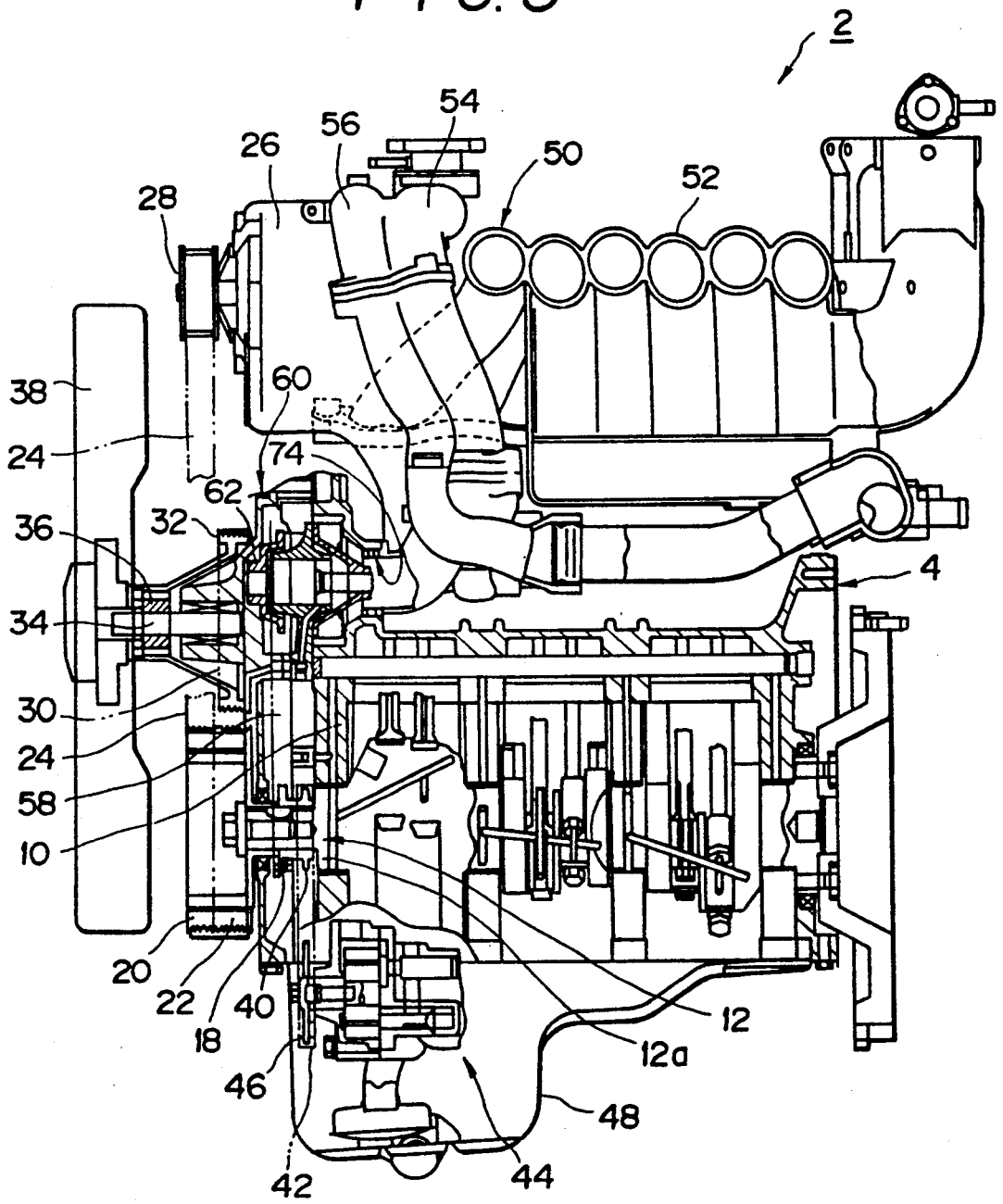
FIG. 3 is a partially cutaway cross-sectional view showing the internal combustion engine of FIG. 2.
Figure 4:
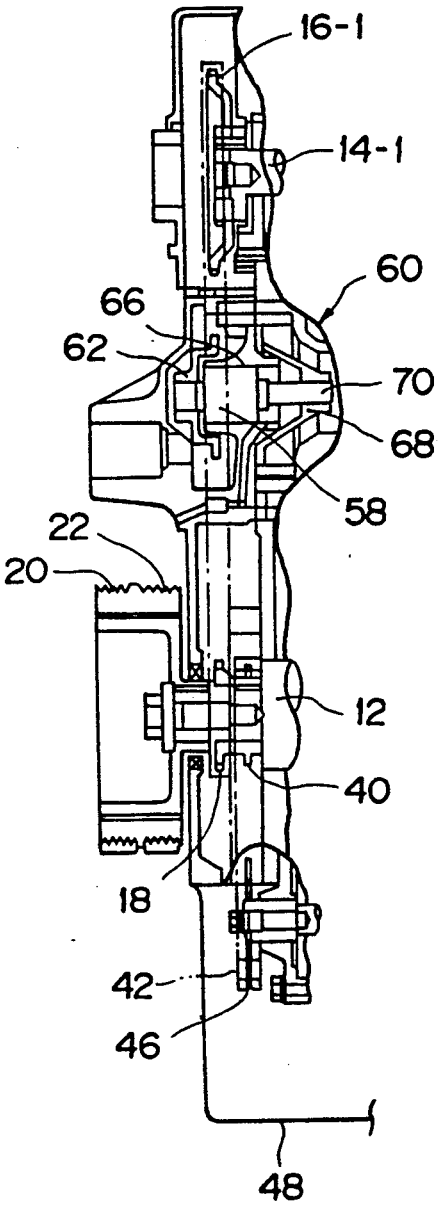
FIG. 4 is a schematically sectional view showing part of the internal combustion engine.
Figure 5:
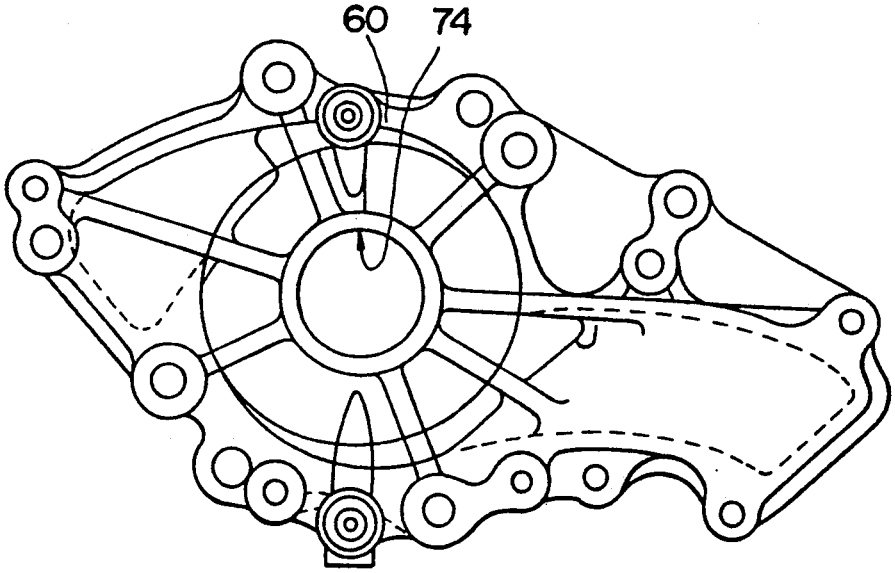
FIG. 5 is a schematic front view showing a position at which the water pump is installed in the present invention.
Figure 6:
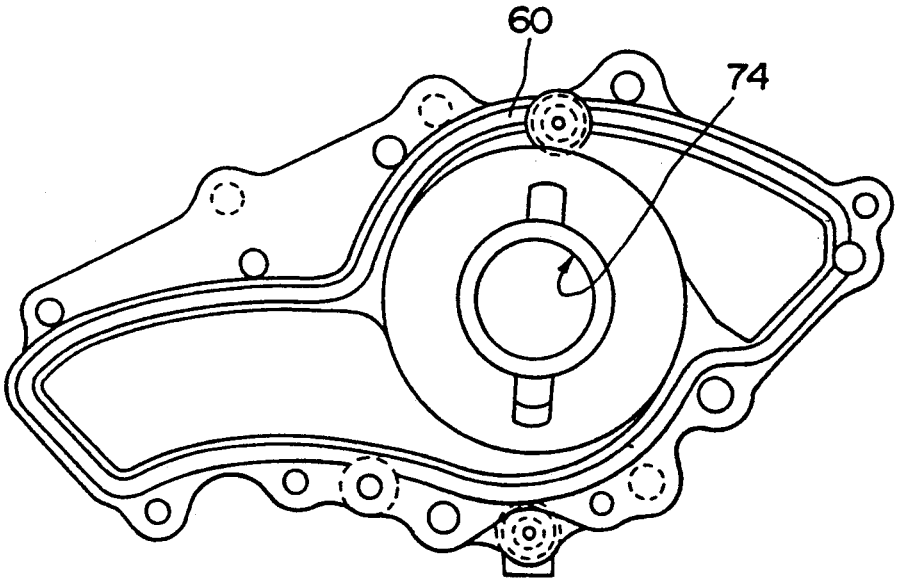
FIG. 6 is a schematic rear view showing the position at which the water pump is installed.

FIGS. 1 to 6 show one embodiment of the present invention. In FIGS. 2 and 3, 2 stands for a V-type internal combustion engine, 4 for a V-shaped cylinder block, 6-1 and 6-2 for the first and the second cylinder banks, and 8-1 and 8-2 for the first and the second cylinder heads. The internal combustion engine 2 consists of those cylinder banks 6-1 and 6-2 in the V-shaped cylinder block 4 on which the first and the second cylinder heads 8-1 and 8-2 are mounted.

As shown in FIG. 3, a crank journal part 12*a* of a crank shaft 12 directed lengthwise of the internal combustion engine 2 is provided rotatably bidirectionally at a front wall 10 of the cylinder block 4. The front end face of the first cylinder head 8-1 is protruded more forwardly than the front end face of the second cylinder head 8-2 relative to the axis of the crank shaft 12.

The first and the second cylinder heads 8-1 and 8-2 are provided with first and second cam shafts 14-1 and 14-2 rotatably bidirectionally. The cam shafts are equipped, at projection ends thereof in the front of the internal combustion engine 2, with first and second cam shaft sprockets 16-1 and 16-2 coextensive (i.e., in a common vertical plane) with one another. A timing chain sprocket 18 is fixed to the end of the crank shaft 12, coextensive with the cam shaft sprockets 16-1 and 16-2.

The crank shaft 12 is equipped with crank pulleys 20 and 22 at the outermost end thereof for driving auxiliary units. An alternator belt 24 is round on the crank pulley 20 and on an alternator pulley 28 of an alternator 26. This alternator, one of the auxiliary units, is disposed on the upper side of the internal combustion engine 2.

A fan belt 30 is wound on the crank pulley 22 and on a fan pulley 32. The fan pulley 32 is rigidly secured to a fan supporter 36 fitted with a fan shaft 34 carried rotatably by the front of the cylinder block 6. A cooling fan 38, one of the auxiliary units, is fixedly secured to the fan shaft 34 and the fan supporter 36.

In addition, an oil pump-driving sprocket 40 is rigidly secured to the end of the crank shaft 12 between the crank journal part 12*a* and the timing chain sprocket 18. An oil pump chain 42 is wound on the oil pump-driving sprocket 40. An oil pump sprocket 46 of an oil pump 44 is disposed coextensively with the oil pump chain 42. The oil pump chain 42 is wound on the oil pump sprocket 46. The cylinder block 4 is equipped with the oil pump 44 on the upper side of an oil pan 48 and toward the side of the second cylinder bank 6-2.

Intake manifolds 52 and first and second cooling water pipes 54 and 56 are disposed in a space 50 defined on the upper side of the cylinder block 4.

Furthermore, a water pump sprocket 62 of a water pump 60 is disposed coextensively with a timing chain 58 to allow the timing chain 58 to drive the water pump 60. Concurrently, the water pump 60 is provided on the upper side of the front wall 10 of cylinder block 4 (one of four end faces of the cylinder block 4) within a timing chain cover 64 (FIG. 1) enclosing the timing chain 58. The water pump 60 is arranged above the crank shaft 12 in the cylinder block 4 and between the first and the second cylinder banks 6-1 and 6-2. The water pump 60 includes a body 66, an impeller 68, and an axial body 70 connected between the impeller 68 and the water pump sprocket 62. The water pump sprocket 62 is provided coextensively with the first and second cam shaft sprockets 16-1 and 16-2 and the timing chain sprocket 18.

The single timing chain 58 is wound between the timing chain sprocket 18, the first cam shaft sprocket 16-1 fixed to the first cam shaft 14-1, the water pump sprocket 62 of the water pump 60, and the second cam shaft sprocket 16-2 fixed to the second cam shaft 14-2 (FIG. 2). The tension of the timing chain 58 is retained by a tensioner 72. The timing chain cover 64 encloses the timing chain 58, the first and second cam shaft sprockets 16-1 and 16-2, and the water pump sprocket 62.

The water pump 60 is communicated with the first cooling water pipe 54, which is fitted to a mounting hole 74 provided at a location where the water pump 60 is installed in the cylinder block 4. A first water drain hole 76 is defined in the body 66 of the water pump 60. A second water drain hole 78 is defined in the timing belt cover 64 and communicates with the first drain hole 76.

When the internal combustion engine 2 is actuated, the crank shaft 12 thereof is revolved with concomitant rotation of pulleys 20 and 22 for respectively driving the alternator 26 by alternator belt 24, and the cooling fan 38 by fan belt 30. The first and second cam shafts 14-1 and 14-2 are rotated by the timing chain 58 which also drives water pump 60. The oil pump 44 is driven by oil pump chain 42.

For installing the water pump 60, it is disposed on the front wall 10 of cylinder block 4 in the internal combustion engine 2. The timing chain 58 is wound on the water pump sprocket 62 of the water pump 60, the water pump 60 and the timing chain 58 are enclosed within the timing chain cover 64, and the water pump 60 is driven by the timing chain 58.

This allows reduction in the overall length and width of the engine 2, achieving a small and lightweight engine. This offers advantages in practical use such as in loading the internal combustion engine 2 into the vehicle, and in providing simple appearance of the engine 2. Also, auxiliary units can be disposed effectively in the extra space made available by the smaller engine.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A water pumping apparatus for an internal combustion engine having a cylinder block with first and second cylinder banks in a V-configuration wherein a cam shaft and a crank shaft are drivingly connected by a timing chain, comprising:

a water pump having a water pump sprocket disposed coextensively with said timing chain to allow said timing chain to drive said water pump; and said water pump being provided at the end face of the cylinder block between said cylinder banks over said crank shaft within a timing chain cover enclosing said timing chain.

2. In an internal combustion engine including an engine block having first and second cylinder banks in a V-configuration, first and second cam shafts rotatably supported on the engine block for controlling respective first and second cylinder valve mechanisms, each said cam shaft having a cam shaft sprocket fixedly attached thereto, a crank shaft rotatably supported on the engine block, a timing chain drivingly engaged between said crank shaft and said cam shaft sprockets, and a timing chain cover supported on the engine block, said timing chain being enclosed within said timing chain cover, the improvement comprising:

a water pumping apparatus including a water pump mounted on a front end portion of the engine block between said cylinder banks over said crank shaft, said water pump including a plump sprocket disposed generally in a common vertical plane with said cam shaft sprockets and drivingly engaged with said timing chain to permit said timing chain to drive said water pump; and said water pump and said timing chain being enclosed together within said timing chain cover.

* * * * *